United States Patent [19]

Hunt

[11] Patent Number: 4,671,039

[45] Date of Patent: Jun. 9, 1987

[54] BLOCK

[75] Inventor: Terrance Hunt, Richardson, Tex.

[73] Assignee: Cecon International NV, Netherlands Antilles

[21] Appl. No.: 632,458

[22] Filed: Jul. 19, 1984

[30] Foreign Application Priority Data

Jul. 19, 1983 [GB] United Kingdom ..... 8319433

[51] Int. Cl.[4] ..... E04C 1/10

[52] U.S. Cl. ..... 52/593; 52/562; 52/590

[58] Field of Search ..... 52/424, 425, 426, 427, 52/428, 421, 422, 438, 442, 561, 562, 586, 606, 589, 593, 590, 594; 446/122, 124, 125, 127

[56] References Cited

U.S. PATENT DOCUMENTS

| | | | |
|---|---|---|---|
| 964,160 | 7/1910 | Hammett | 52/589 |
| 1,271,447 | 7/1918 | Doern | 52/562 |
| 1,360,183 | 11/1920 | Cosgrove | 52/606 X |
| 1,377,062 | 5/1921 | De Forrest | 52/422 |
| 1,654,631 | 1/1928 | Bevier | 52/594 X |
| 1,953,154 | 4/1934 | Cram | 52/590 X |
| 2,472,363 | 6/1949 | Blackington | 446/127 |
| 3,888,060 | 6/1975 | Haener | 52/589 X |
| 4,258,522 | 3/1981 | Amaral | 52/589 X |

FOREIGN PATENT DOCUMENTS

| | | | |
|---|---|---|---|
| 58269 | 12/1942 | Austria | 446/125 |
| 171882 | 7/1952 | Austria | 52/590 |
| 2345568 | 4/1975 | Fed. Rep. of Germany | 52/593 |
| 2550240 | 12/1977 | Fed. Rep. of Germany | 52/606 |

*Primary Examiner*—William F. Pate, III
*Assistant Examiner*—Creighton Smith
*Attorney, Agent, or Firm*—Brown, Martin Haller & Meador

[57] ABSTRACT

A building block for use in building a structure consisting of linear or stepped courses of a plurality of blocks is designed such that any two types are required, a full block and a half block. Each full or half block consists of a substantially parallel piped body having upper and lower faces, opposed side walls and opposed end walls. The side walls and the end walls define a central cavity and the blocks are arranged to receive similar blocks in overlying and underlying relationship. The outer surfaces of the side walls and end walls each include interlocking means, preferably in the form of fluting, any of which may be interengaged with any of the interlocking means of the outer surfaces of another building block of the same type. In a structure the blocks may interlock with a juxtaposed block in side to side, end to end, or end to side disposition.

13 Claims, 18 Drawing Figures

BLOCK

This invention relates to an improved block and in particular to an interlocking block and to a building system including such a block.

In the past there have been many proposals for interlocking blocks but these have generally been beset by the problem that, in order to construct a building, from four to eight different types of block are required for example different designs of block would be needed to turn corners.

An object of the present invention is to provide an improved block which enables the number of block types required to build a structure to be reduced.

According to the present invention there is provided a building block for use in building a structure consisting of courses of a plurality of said blocks, the building block comprising a substantially parallel piped body having upper and lower faces, opposed side walls and opposed end walls, the side walls and end walls defining a cavity therebetween and having upper and lower surfaces configured so that the upper and lower faces of one block may receive similar blocks laid in overlying and underlying relationship to form courses therewith, and interlocking means on the outer surfaces of each of said opposed side walls and opposed end walls, the interlocking means of any one of said outer surfaces being interengageable with any one of the interlocking means of the outer surfaces of another building block provided with the same interlocking means. Preferably the interlocking means comprises fluting consisting of three alternately arranged tongues and grooves disposed intermediate flat edge portions. The courses of blocks may be linear or stepped in stacked bond or staggered running bond position as desired.

The invention also includes a building block for use in building a structure consisting of linear courses of a plurality of said blocks, the building block comprising a substantially parallel piped body having upper and lower faces, opposed side faces and opposed end faces, first and second interlocking means on each of said side faces, and third interlocking means on each of said side faces, and any one of said first, second or third interlocking means being cooperable with any one of first, second or third interlocking means of a second block of the same type, and the first and second interlocking means of one side of the block together being cooperable with the first and second interlocking means of one side of the block together being cooperable with the first and second interlocking means of either side of a second block of the same type whereby, in a building or structure made from a plurality of said blocks, juxtaposed blocks in adjacent courses may be interlocked in whole side to whole side, part side to part side, end to end or end to side disposition. Preferably the building block includes cooperating location means on the upper and lower faces of the block which locate with juxtaposed blocks laid in staggered relationship in linear courses above and below.

According to another aspect of the invention there is provided a building system for building a structure comprising a plurality of blocks of two block types only, each block type comprising a substantially parallel piped body having upper and lower faces, opposed side faces and opposed end faces, and cooperable interlocking means on each of said side faces and said end faces, one block type having side faces substantially twice as long as the side faces of the other block type and including two interlocking means whereby said one block type may interlock with juxtaposed block of either type in side to side, end to end or end to side disposition. The blocks may be assembled in stepped or linear courses and may be in stacked or running bond position.

The invention will now be described by way of example with reference to the accompanying drawings in which.

Figure 1:
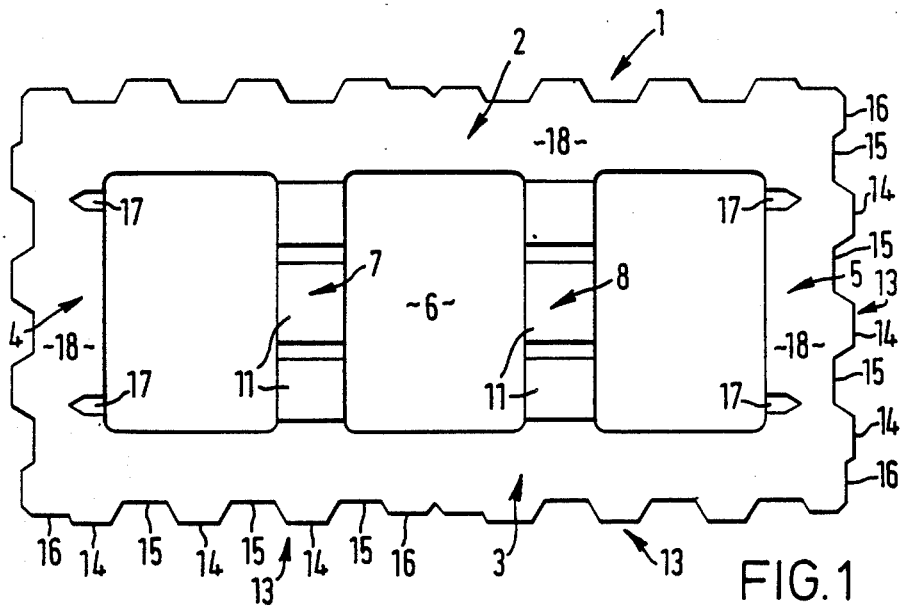
FIG. 1 is a plan view of a full block in accordance with the invention.
Figure 2:
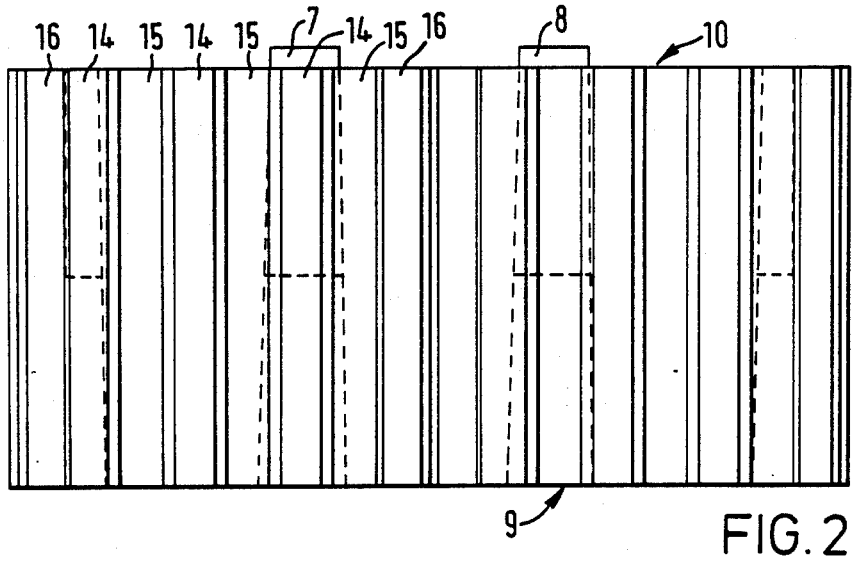
FIG. 2 is a side elevation of the full block shown in FIG. 1.
Figure 3:
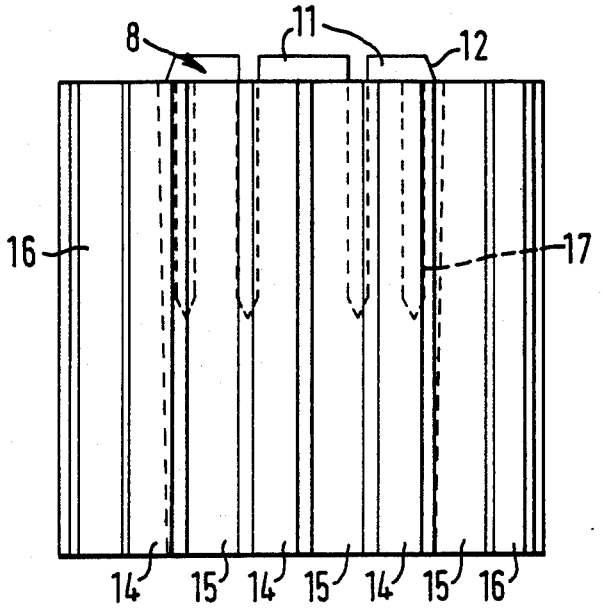
FIG. 3 is an end elevation of the full block shown in FIG. 1.

In FIGS. 1 to 3 of the drawings a full block 1 is substantialy rectangular in plan view and has two longer side walls 2 and 3 and two shorter end walls 4 and 5. The two longer side walls 2 and 3 are spaced apart to form inner and outer spaced and parallel walls of a building structure and are connected together by the two shorter end walls 4 and 5 so that the side and end walls together define a central cavity 6.

Disposed intermediate the two shorter end walls 4 and 5 are two interconnecting webs 7 and 8 which are parallel to the shorter end walls 4 and 5. The interconnecting webs 7 and 8 extend from a lower face 9 of the block 1 and project beyond the upper face 10 of the block as clearly seen from the dotted lines in FIG. 2. The upper portion of each web 7 and 8 extending from about half-way between the lower face 9 and the upper face 10 of the block 1 is trifurcated to provide frangible sections 11 which may be broken away as required. For example, when turning a corner one of the webs 7 or 8 of the corner block would be broken away to allow a similar block to be seated in overlying relationship but perpendicular thereto, or when forming a structure with full blocks in stack bond position i.e. where the blocks in adjacent courses are not staggered, both webs 7 and 8 would be broken away. The webs 7 and 8 support the side walls 2 and 3 during moulding and in the normal staggered running bond position, by projecting above the upper face 10 of the block, serve to locate the overlying courses of blocks as a building or structure is constructed. The lateral projecting edges of the webs 7 and 8 are chamfered at 12 as shown in FIG. 3 to facilitate this location. The side walls 2 and 3, the end walls 4 and 5 and the webs 7 and 8 are slightly tapered from the lower face 9 to the upper face 10 to help moulding.

The outer surfaces of the side and end walls of block 1 are all formed with an interlocking means 13 in the form of fluting which extends between the lower and upper faces 9 and 10 of the block. Each interlocking means 13 comprises fluting consisting of three alternately arranged tongues and grooves 14 and 15 disposed intermediate flat edge portions 16. It will be seen from the figures that the tongues and grooves on the outer surface of one of the side or end walls are the mirror image of the tongues and grooves on the respective opposed side and end walls. The tongues and grooves 14 and 15 are tapered at an angle of about 30°.

The fluting on the side walls 2 and 3 comprises two interlocking sections 13 and because all the interlocking sections 13 correspond a plurality of blocks in a building may be interlocked in several different ways for example end to end, whole side to whole side, half side to half side or end to side. The tapered configuration or the fluting facilitates interlocking.

As also shown in FIGS. 1, 2 and 3 the full block 1 comprises four slots 17 in the inner surfaces of the end walls 4 and 5 which extend about half-way between the upper and lower faces 10 and 9 of the block. The slots 17 aid in enabling the top portion of the end walls 4 and 5 to be cut or broken away to receive, for example, service fixtures or to form lintel blocks. The upper and lower surfaces 18 of the side and end walls, 2 and 3 and 4 and 5 respectively, are made entirely flat so that the upper and lower faces 10 and 9 of the block as a whole may receive similar blocks in overlying and underlying relationship to form linear courses of blocks in which the load is transmitted through the whole width of the side and end walls.

Figure 4:
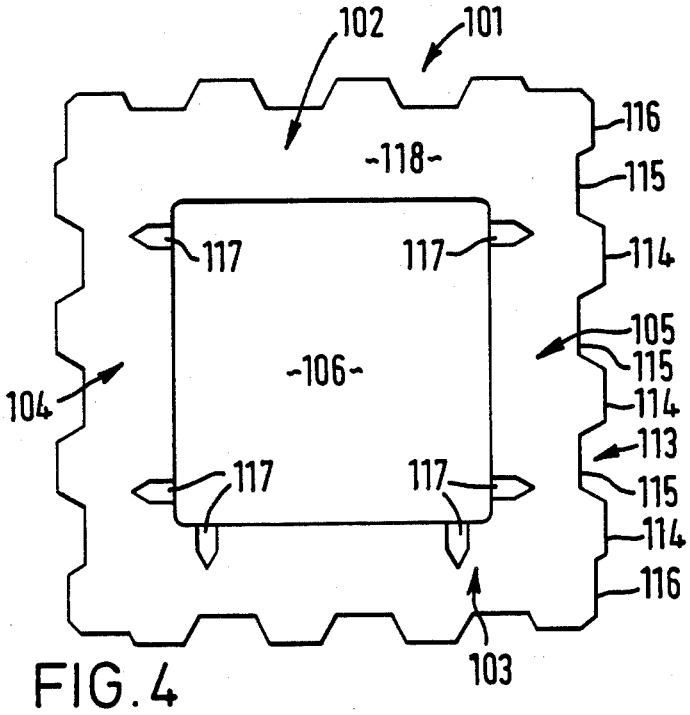
FIG. 4 is a plan view of a half block in accordance with the invention.
Figure 5:
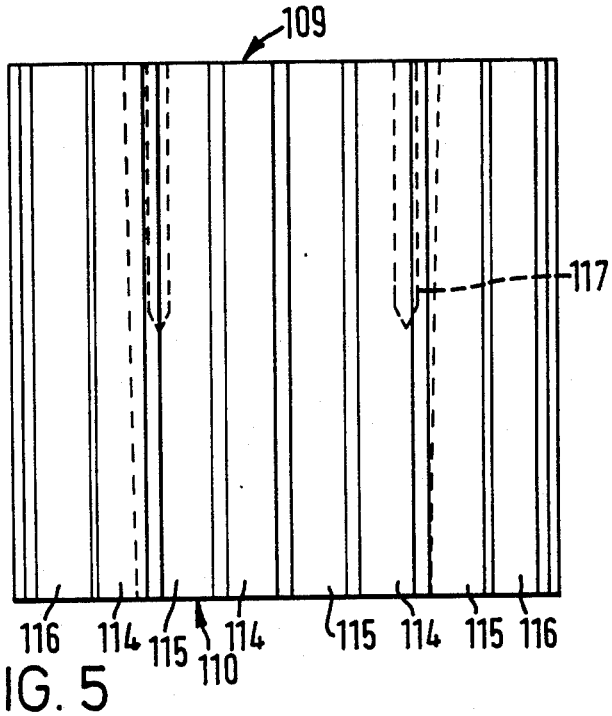
FIG. 5 is an end elevation of the half block shown in FIG. 4.
Figure 6:
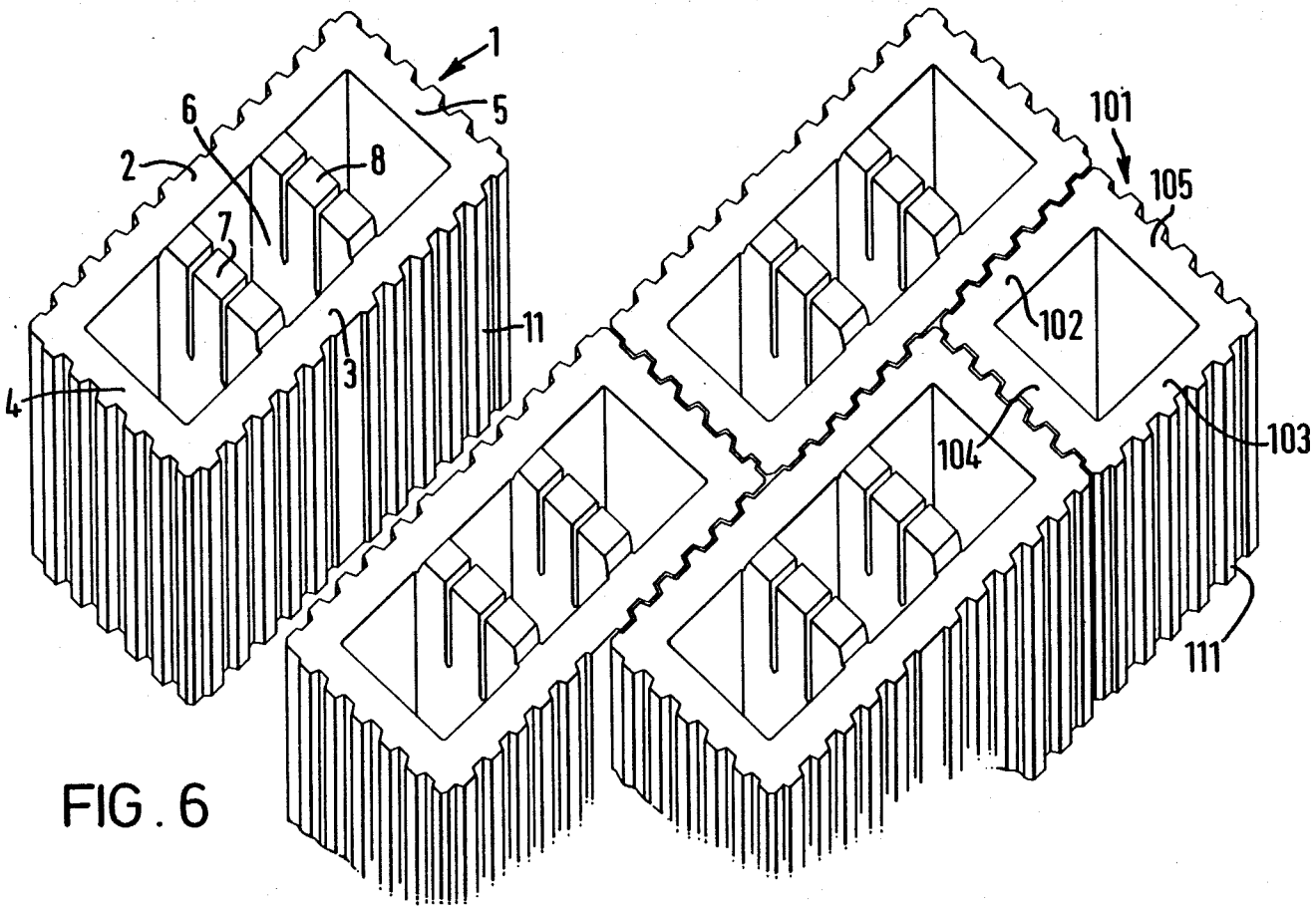
FIG. 6 shows how the blocks fit together in sue.

FIGS. 4 and 5 illustrate a half block 101 which is similar to the block 1 and therefore corresponding portions ave been given the same numbers but in the hundred series. The half block 101 differs from the full block 1 in that the side walls 102, 103 are half the length of the side walls 2 and 3 and each only include one interlocking means 113 and an extra set of slots 117 are provided. In addition, because the block is substantially square, no interconnecting webs are required. The interlocking means 113 are the same configuration as the interlocking sections 13 so that the half-blocks 101 can interengage with the full blocks 1. The full and half blocks 1 and 101 may be fitted together as shown in FIGS. 6 or 10 to 18.

As can be seen in FIGS. 1 and 4, the two half sections or lengths of the interlocking means on each of the side and end faces of each block are not symmetrical about the center line extending from the upper to the lower face of the block and bisecting that face, but are in fact inverted mirror images of one another. Thus, looking at one of the said walls or faces 2 of the block shown in FIG. 1, the two half sections of that wall about its mid-point are not symmetrical, but are in fact inverted mirror images of one another. If each half section is further divided into two equal halves, each of those halves will also be an inverted mirror image of the other. The two halves of each of the end walls 4 and 5 are also not symmetrical about the block center line bisecting those faces, but are each inverted mirror images of one another. It can be seen that the transverse center lines bisecting each of the side and end faces in fact bisect angled portions of the interlocking means, i.e. they pass through a mid-point in the angled portion connecting a tongue and groove. This arrangement ensures that any of the interlocking means of any side or end wall may engage with any of the interlocking means of another block, i.e. any one of the four walls of another block. Thus, for example, any side wall can engage with the equivalent or opposite side wall, or either end wall, of another block.

Figure 7:
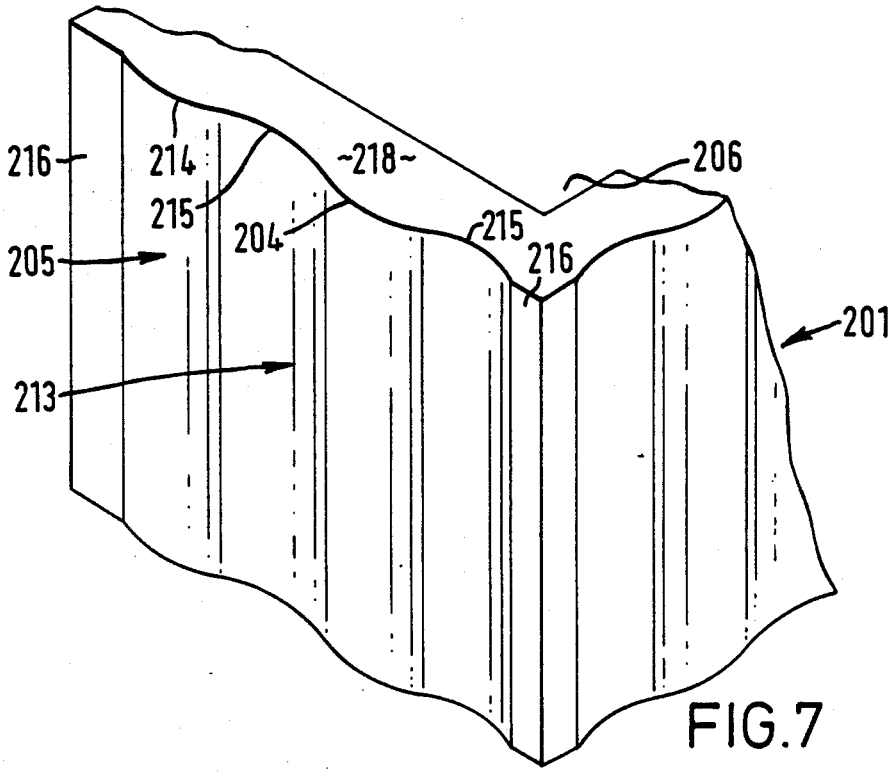
FIGS. 7, 8 and 9 are perspective views of different configurations of interlocking means.
Figure 8:
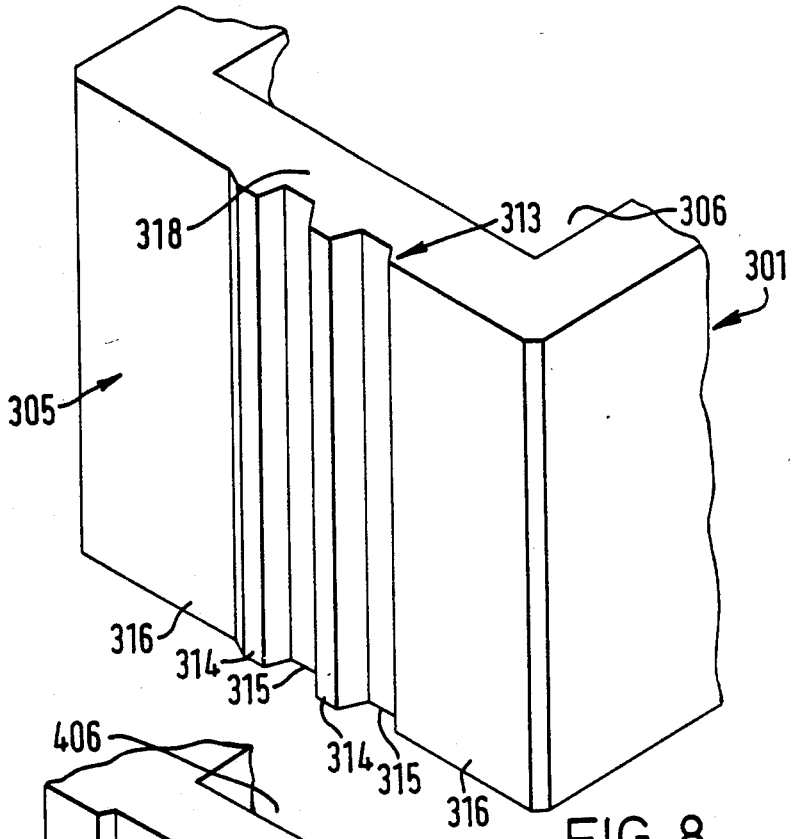
Figure 9:
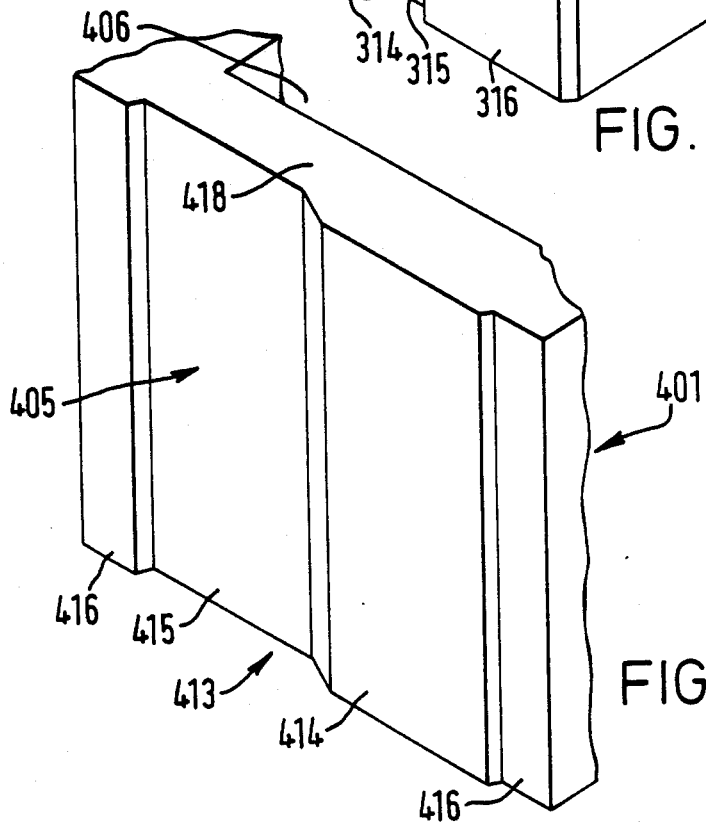
Figure 10:
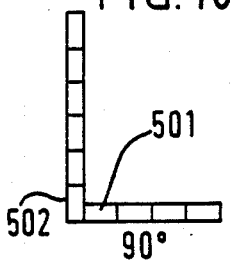
FIGS. 10 to 18 illustrate diagrammatically the versatility of the blocks of the present invention.

FIGS. 7, 8 and 9 of the accompanying drawings are perspective views of alternative configurations for the interlocking means. Thus, in FIG. 7, the interlocking means 213 of block 201 (only partly shown) comprises fluting of curvilinear cross-section consisting of two curvilinear tongues 214 arranged alternately with two curvilinear grooves 215 disposed intermediate flat edge portions 216. In the arrangement of FIG. 8 the fluting of block 301 is similar to that of the preferred embodiment shown in FIGS. 1 to 6 but extends across a much shorter area.

In FIG. 9 the interlocking means 413 of block 401 comprises a single large tongue 414 and a single large groove 415 disposed intermediate the flat edge portions 416.

Figure 11:
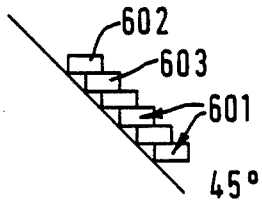
Figure 12:
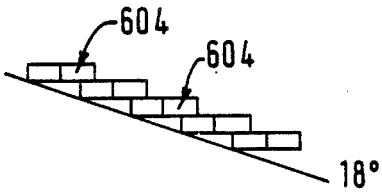
Figure 13:
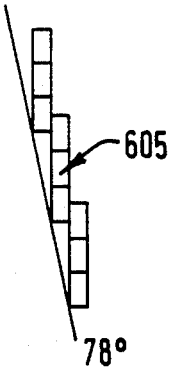

The two blocks of the present invention are extremely versatile and, in addition to the standard straight run with the blocks in linear courses of staggered running bond relationship, may accommodate many different applications some of which are illustrated in FIGS. 10 to 18 where the blocks are as illustrated in FIGS. 1 to 6 but drawn diagrammatically for clarity. Thus, in FIG. 10, a 90° corner using full blocks is illustrated, the end face of one block 501 linking with one of the side interlocking means of the block 502. In FIG. 11 the full blocks 601 are set at an angle of 45° with the interlocking means on one side and at one end of a first block 602 interlocking with the interlocking means on the other side and at the other end of a second block 603 and so on. In FIGS. 12 and 13 similar arrangements using two blocks 604 and three blocks 605 are shown to provide angles of 18° and 78° respectively as shown. It will be noted that in these arrangements the courses of blocks are in stepped courses with the blocks in stack bond position.

Figure 14:
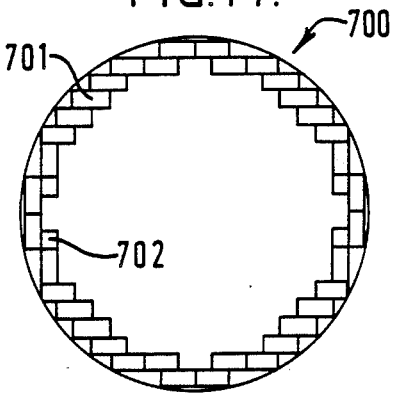
Figure 15:
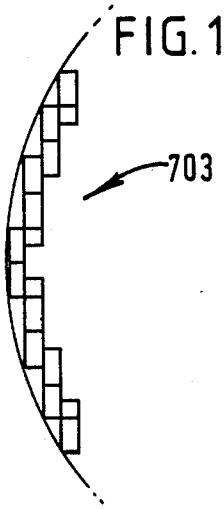

In FIG. 14 a circular structure 700 of 10 ft diameter is illustrated using a combination of interlocking full blocks 701 and half blocks 702. In FIG. 15 part of a similar structure 703 is illustrated which again used both half and full blocks 704, 705 but providing a 10 ft radius.

Figure 16:
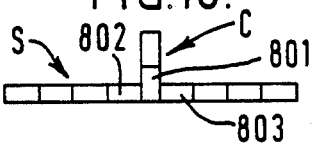
Figure 17:
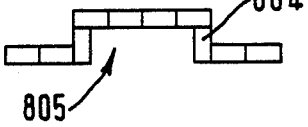
Figure 18:
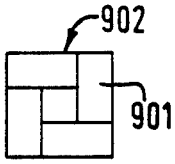

FIG. 16 shows a cross wall C locked through a straight wall S where the interlocking means on both sides at one end of the full block 801 of interlock respectively with an end of each of the adjacent blocks 802, 803 in the straight wall S. A similar arrangement is shown in FIG. 17 where the full blocks 804 form a 4 ft pier 805 in a straight wall. The full blocks 901 in FIG. 18 are arranged and interlocked end to side to form an 18 inch column 902.

The unique configuration of the block in accordance with the invention has many advantages, for example:

(i) as a building is made primarily of full blocks which are able to locate on all six surfaces, positioning is extremely accurate in a structure of alternate courses of staggered blocks;

(ii) the blocks have end walls and side walls which are mirror images of one another so that a builder is able to place the blocks either way round. Accordingly, no decision in this respect is required by unskilled labour. Moreover, if one side or end surface is chipped or otherwise damaged the other side or end surface may be exposed.

(iii) the provision of two interlocking sections on each side wall of the full block mean that no special corner block or partition block is required, a perpendicular wall may be positioned as desired;

(iv) because the upper and lower surfaces of the side and end walls are flat load bearing is provided by the whole width of the side and end walls of the block;

(v) the blocks are as near a conventional block in shape as possible so that the blocks may be moulded on a flat pallet by conventional processes e.g. by using a BESCOPAC machine of the Besser Company whilst also providing the unique interlocking arrangement; and (vi) most importantly, the configuration of blocks means that only two blocks are required for a building system.

A structure may suitably be formed upon a foundation and linear courses of a plurality of block may be assembled as desired. Vertical reinforcement may be provided by filling certain parts of the central cavity with metallic-reinforced cement. The blocks may be assembled dry or with cement and the finished building may be rendered or the blocks themselves provided with a desired finish.

I claim:

1. A building block for use in building a structure consisting of courses of a plurality of said blocks, the building block comprising a substantially parallel piped body having upper and lower faces, opposed side walls and opposed end walls, the side walls and end walls defining a cavity therebetween and having upper and lower surfaces configures so that the upper and lower faces of one block may receive similar blocks laid in overlying and underlying relationship to form courses therewith, and interlocking means on the outer surfaces of each of said opposed side walls and opposed end walls for engagement with any one of the interlocking means of the outer surfaces of another building block provided with the same interlocking means, the interlocking means each including at least one tongue and at least one groove, the profile of one half of each interlocking means on each of the opposed side and end walls taken about the center line bisecting the interlocking means of the respective side or end wall being the inverted mirror image of the profile of the other half of the interlocking means on that wall, and the interlocking means of each one of the opposed side walls and opposed end walls being the inverse of the interlocking means on the directly opposed side and end walls, respectively, for interlocking juxtaposed blocks in any chosen one of a plurality of different possible configurations including side to side, end to end, or side to end disposition.

2. A building block according to claim 1 wherein the upper and lower surfaces of the side walls and end walls of the block are substantially flat whereby one block may be laid upon another.

3. A building block according to claim 2 wherein the block is a full block, substantially rectangular in plan, the outer surfaces of each of said side walls including two interlocking means.

4. A building block according to claim 1 including location means projecting from the upper face of the block and which may locate within the lower face of a similar block laid in staggered position in a linear course above it.

5. A building block according to claim 1, including at least one transverse web interconnecting the opposed side walls of the block intermediate the said opposed end walls, the transverse web having portions thereof projecting from the upper face of the block laid in staggered relationship in the linear course above it.

6. A building block according to claim 1, wherein the interlocking means comprises fluting extending between the upper and lower faces of the block.

7. A building block according to claim 6 wherein the fluting of each interlocking means comprises three alternately arranged tongues and grooves disposed intermediate flat edge portions, the tongues and the grooves on the outer surface of one of the side or end walls being the mirror image of the tongues and grooves on the respective opposed side and end walls.

8. A building block according to claim 7 wherein the tongues and grooves are tapered at an angle of about 30°.

9. A building block according to claim 6 wherein the interlocking means comprises curvilinear fluting.

10. A building block for use in building a structure consisting of courses of a plurality of said blocks, the building block comprising a substantially parallel piped body having upper and lower faces, opposed side faces and opposed end faces, first and second interlocking means on each of said side faces, and third interlocking means on each of said end faces, any one of said first, second and third interlocking means comprising means for cooperation with any one of the first, second and third interlocking means of a second block of the same type, and the first and second interlocking means of one side of the block together comprising means for cooperation with the first and second interlocking means of either side of a second block of the same type, the first and second interlocking means of each side face being defined on opposite sides of a block center line bisecting that face, and comprising inverted mirror images of one another, whereby, in a building or structure made from a plurality of said blocks, juxtaposed blocks in adjacent courses may be interlocked in whole side to whole side, part side to part side, end to end, or end to side disposition.

11. A building system for building a structure comprising a plurality of blocks of two block types only, each block type comprising a substantially parallel piped body having upper and lower faces, opposed side faces and opposed end faces, and cooperable interlocking means on each of said side faces and end faces, each of said interlocking means of any one of said blocks comprising means for cooperation with any one of the interlocking means on any outer opposed side or end face of another of said blocks to interlock said blocks in any one of a plurality of different possible configurations, one block type having side faces substantially twice as long as the side faces of the other block type and including two of said interlocking means whereby said one block type may interlock with a juxtaposed block of either type in any of said possible configurations including side to side, end to end or end to side disposition.

12. A building system for building a structure comprising a plurality of blocks of two types only, each block type comprising a substantially parallel piped body having upper and lower faces, opposed side faces and opposed end faces, and cooperable interlocking means on each of said side faces and end faces, each of said interlocking means of any one of said blocks comprising means for cooperation with any one of the interlocking means on any outer opposed side or end face of another of said blocks in any one of a plurality of different possible configurations, opposite halves of each of the interlocking means on a respective side or end face taken along a center line bisecting the interlocking means which extends between the upper and lower faces of the block being inverted mirror images of one another, one block type having side faces substantially twice as long as the side faces of the other block type and including two of said interlocking means whereby said one block type may interlock with a juxtaposed block of either type in any of said possible configurations including side to side, end to end or end to side disposition.

13. The block according to claim 1, wherein there are two interlocking means on each side wall, the profile of one interlocking means on each side wall being the inverted mirror image of the other interlocking means on the same side wall.

* * * * *